US010307820B2

(12) United States Patent
Shiga et al.

(10) Patent No.: US 10,307,820 B2
(45) Date of Patent: Jun. 4, 2019

(54) SUCTION PRESSURE CASTING METHOD

(71) Applicant: Nissan Motor Co., Ltd., Yokohama-shi, Kanagawa (JP)

(72) Inventors: Hidetoshi Shiga, Kanagawa (JP); Shinnichi Tsuchiya, Kanagawa (JP); Tatsuya Masuta, Kanagawa (JP); Kenji Hayashi, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 15/570,388

(22) PCT Filed: May 22, 2015

(86) PCT No.: PCT/JP2015/064721

§ 371 (c)(1),
(2) Date: Oct. 30, 2017

(87) PCT Pub. No.: WO2016/189580

PCT Pub. Date: Dec. 1, 2016

(65) Prior Publication Data

US 2018/0133788 A1 May 17, 2018

(51) Int. Cl.

| | |
|---|---|
| ***B22D 18/04*** | (2006.01) |
| ***B22D 18/06*** | (2006.01) |
| ***B22D 18/08*** | (2006.01) |
| ***B22C 9/00*** | (2006.01) |
| ***B22D 17/22*** | (2006.01) |

(52) U.S. Cl.

CPC ..... *B22D 18/06* (2013.01); *B22C 9/00* (2013.01); *B22D 17/22* (2013.01); *B22D 18/04* (2013.01); *B22D 18/08* (2013.01)

(58) Field of Classification Search

CPC ..... B22D 18/06

See application file for complete search history.

(56) References Cited

U.S. PATENT DOCUMENTS 5,551,502 A 9/1996 Matsubayashi et al.
5,597,032 A * 1/1997 Merrien ..... B22D 18/08 164/155.2

(Continued)

FOREIGN PATENT DOCUMENTS

CN 1676241 A 10/2005
CN 1709613 A 12/2005

(Continued)

*Primary Examiner* — Kevin E Yoon
*Assistant Examiner* — Jacky Yuen
(74) *Attorney, Agent, or Firm* — Global IP Counselors, LLP

(57) ABSTRACT

A suction pressure casting method uses a casting device that includes a holding furnace for accumulating molten metal, a metal mold and a core forming a cavity, a molten-metal pressurizing tank that supplies a pressurizing gas, and a suction and exhaust tank for sucking and exhausting the inside of the cavity. A preset decompression pattern of a casting process is compared with a measured pressure pattern of the cavity and the core that is measured during actual casting. A corrected decompression pattern is calculated based on a difference therebetween. The preset decompression pattern at the time of the next casting is then corrected by using the corrected decompression pattern.

5 Claims, 7 Drawing Sheets

(56) References Cited

U.S. PATENT DOCUMENTS

| | | | | |
|---|---|---|---|---|
| 6,311,758 | B1 * | 11/2001 | Sakabe | B22D 18/06 164/255 |
| 2005/0217821 | A1 | 10/2005 | Fukumoto et al. | |

FOREIGN PATENT DOCUMENTS

| | | | | |
|---|---|---|---|---|
| CN | 102274948 | A | 12/2011 | |
| CN | 102554184 | A | 7/2012 | |
| CN | 103785814 | A | 5/2014 | |
| FR | 2523882 | A2 * | 9/1983 | B22D 18/08 |
| JP | S57-37559 | U | 2/1982 | |
| JP | S61-99553 | A | 5/1986 | |
| JP | 5-363 | A | 1/1993 | |
| JP | H05-228604 | A | 9/1993 | |
| JP | H05-228605 | A | 9/1993 | |
| JP | 7-60429 | A | 3/1995 | |
| JP | 8-33944 | A | 2/1996 | |
| JP | 2002-35918 | A | 2/2002 | |
| KR | 10-1995-0031325 | A | 12/1995 | |

* cited by examiner

SUCTION PRESSURE CASTING METHOD

CROSS-REFERENCE TO RELATED APPLICATIONS

This application is a U.S. National stage application of International Application No. PCT/JP2015/064721, filed May 22, 2015.

BACKGROUND

Field of the Invention

The present invention relates to a suction pressure casting method in which molten metal is pressurized and poured into a cavity of a metal mold, and the cavity is suctioned and exhausted.

Background Information

As a casting method to suction and exhaust the cavity when pouring molten metal therein, the method is disclosed in Japanese Laid Open Patent Application No. Hei 8 (1996)-33944 (Cited Document 1), entitled Method for Pouring Molten Metal under Partial Reduced Pressure into Casting. In the casting method disclosed in Cited Document 1, a casting mold that forms a cavity together with a core is used, and molten metal is poured into the cavity while the cavity is suctioned and exhausted with an exhaust pump. In the casting method of Cited Document 1, the molten metal is poured under gravity; however, for example, a suction pressure casting method in which the cavity is suctioned and exhausted when pressurizing and filling the cavity with molten metal using a low-pressure casting device is also well known.

In addition, in the suction pressure casting method, when controlling the suctioning and exhausting of the cavity, a method is employed in which the opening amount of the exhaust valve is adjusted using a vacuum tank and an exhaust valve that opens and closes a suction and exhaust path from the vacuum tank to the cavity.

SUMMARY

In the suction pressure casting method described above, since the suction and exhaust is controlled using a vacuum tank and an exhaust valve, while responsiveness is increased compared with an exhaust pump, if the pouring time for the molten metal is short, a delay occurs in the operation of the exhaust valve, and it becomes difficult to feedback-control the opening amount of the exhaust valve in real time based on the pressure inside the cavity. Therefore, a preset decompression pattern (pattern of the opening amount of the exhaust valve), which is set in advance in accordance with the series of the casting process, is used, and the opening amount of the exhaust valve is controlled based on this preset decompression pattern.

However, in casting that uses a core, the amount of moisture contained in the core and the hardened state using a binder (polymerization state and the firing state of the binder) are different, and the amount of moisture and the hardened state will also be different depending on the production lot and the storage condition of the core. Consequently, in the conventional suction pressure casting method, the amount of gas that is generated from the core during casting changes, and a difference is generated between the preset decompression pattern, and the ideal decompression pattern that is necessary to carry out suction and exhaust including the actual amount of gas that is generated, creating the risk of a misrun or the occurrence of gas defect due to the difference, so that solving such problems is challenging.

The present invention was conceived in view of the conventional problems described above, and an object thereof is to provide a suction pressure casting method that uses a core, wherein the pressure of a cavity and the core during casting is measured and the preset decompression pattern at the time of the next casting is corrected based on the measurement results, thereby making it possible to suppress the occurrence of a misrun or gas defect, even when the amount of moisture and the hardened state of the core are different.

The suction pressure casting method according to the present invention uses a casting device comprising a holding furnace in which molten metal is accumulated, a metal mold that forms a cavity together with a core, a molten-metal pressurizing means for supplying pressurizing gas into the holding furnace, and a suction-exhaust means for suctioning and exhausting the inside of the cavity, wherein molten metal is pressurized and poured into the cavity of the metal mold, and the cavity is suctioned and exhausted.

At this time, the suction pressure casting method is configured to compare a preset decompression pattern of the suction-exhaust means that is set in advance according to a casting process with a measured pressure pattern of the cavity and the core that is measured during actual casting, to calculate a corrected decompression pattern of the suction-exhaust means based on the difference therebetween, and to correct the preset decompression pattern at the time of the next casting by using the corrected decompression pattern, as a means to solve the conventional problem with the configuration described above.

By employing the configuration described above in the suction pressure casting method according to the present invention, the difference between the preset decompression pattern and the ideal decompression pattern that is necessary to carry out suction and exhaust including the actual amount of gas that is generated becomes small, and it is possible to suppress occurrence of a misrun or a gas defect, even when the hardened state using a binder and the amount of moisture of the core are different.

BRIEF DESCRIPTION OF THE DRAWINGS

Referring now to the drawings, a suction pressure casting device and a suction pressure casting method are illustrated.

DETAILED DESCRIPTION OF THE EMBODIMENTS

Figure 1:
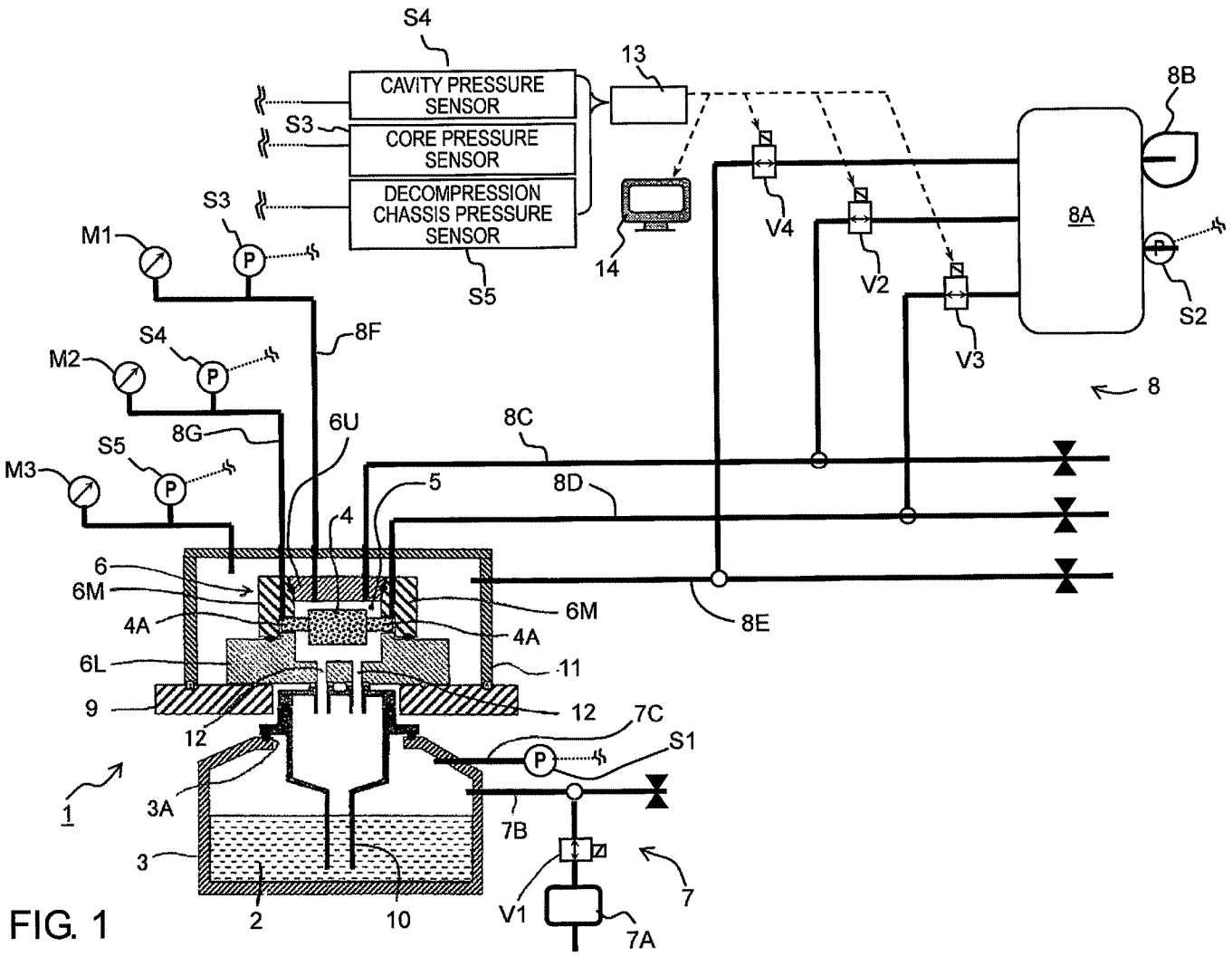
FIG. 1 is a system diagram for explaining a suction pressure casting device to which a suction pressure casting method according to the present invention can be applied.

As illustrated in FIG. 1, a suction pressure casting device 1 is a device to which a suction pressure casting method according to the present invention can be applied by employing a low-pressure casting device as a basic configuration, and the device comprises a means for filling a cavity with molten metal, a means for exhausting the cavity and a control system of these means.

That is, the suction pressure casting device 1 comprises a holding furnace 3 in which molten metal 2 is accumulated, a metal mold 6 that forms a cavity 5 together with a core 4, a molten-metal pressurizing means 7 for supplying pressurizing gas into the holding furnace 3, and a suction-exhaust means 8 for suctioning and exhausting the interior of the cavity 5.

In addition, the suction pressure casting device 1 comprises a base 9 for vertically disposing the metal mold 6 and the holding furnace 3, a stoke 10, which is an ascending path of the molten metal 2 from the holding furnace 3 to the cavity 5, and a decompression chassis 11 for hermetically enclosing the metal mold 6 on the base 9.

The holding furnace 3 holds the upper portion of the stoke 10 at an upper open portion 3A, and comprises a heater (not shown) for heating the molten metal 2, and the like. The stoke 10 has a basin in the upper portion, and the lower end portion is immersed in the molten metal 2 of the holding furnace 3. The decompression chassis 11 is formed from a plurality of housings, which are not shown, and can be opened and closed, in the same manner as the metal mold 6.

The metal mold (mold/casting mold) 6 comprises a lower die 6L fixed to the base 9, an upper die 6U that can rise and fall facing the lower die 6L, and an advanceable and retractable intermediate die 6M that is disposed between the lower die 6L and the upper die 6U, and forms a cavity 5 as the casting space together with the core 4. The lower die 6L comprises a sprue 12 that communicates with the upper side of the stoke 10.

The core 4 is obtained by using a mixture of core sand and a binder and forming the mixture into a predetermined shape by a forming mold, and there are cores that use an organic binder (hereinafter referred to as "shell core") and cores that use an inorganic binder (hereinafter referred to as "inorganic core"). In addition, the core 4 in the illustrated example comprises a frame 4A on both sides, and is positioned in the metal mold 6 in a state in which the frames 4A are sandwiched between the lower die 6L and the intermediate die 6M.

The molten-metal pressurizing means 7 comprises a pressurized gas tank 7A into which pressurizing gas is introduced, an air supply pipe 7B leading from the pressurized gas tank 7A to the holding furnace 3, and an air supply valve V1 that opens and closes the middle of the air supply pipe 7B. One example of the pressurizing gas is air. The holding furnace 3 is provided with a holding furnace pressure sensor S1 for detecting the pressure inside the holding furnace 3 through a sensor pipe 7C.

The suction-exhaust means 8 comprises a vacuum tank 8A, a vacuum pump 8B that suctions and exhausts the inside of the vacuum tank 8A, and a tank pressure sensor S2 that detects the pressure of the vacuum tank 8A. Furthermore, the suction-exhaust means 8 comprises a first exhaust pipe 8C extending from the vacuum tank 8A to the cavity 5 of the metal mold 6, a second exhaust pipe 8D that extends from the vacuum tank 8A to the portions of the frames 4A of the core 4 inside the metal mold 6, and a third exhaust pipe 8E that extends from the vacuum tank 8A to the decompression chassis 11. The first to the third exhaust pipes 8C-8E are provided with first to third exhaust valves V2-V4, respectively, which open and close the middle thereof.

In addition, the suction-exhaust means 8 comprises a cavity pressure sensor S3 that detects the pressure of the cavity 5 through a sensor pipe 8F, a core pressure sensor S4 that detects the pressure of the portions of the frames 4A of the core 4 through another sensor pipe 8G, and a decompression chassis pressure sensor S5 that detects the pressure inside the decompression chassis 11 through yet another sensor pipe 8H. Furthermore, in addition to the respective pressure sensors S3-S5, the sensor pipes 8F-8G are provided with pressure gauges M1-M3, respectively.

Furthermore, the suction pressure casting device 1 comprises a main control device 13 configured from a computer, and a monitor 14 as a display means for displaying various types of data. The main control device 13 inputs detection signals from each of the pressure sensors S1-S5, and outputs command signals for driving to the vacuum pump 8B, the air supply valve V1, and the first to the third exhaust valves V2-V4.

This main control device 13 executes the suction pressure casting method according to the present invention using the above-described suction pressure casting device 1, and a preset decompression pattern of the suction-exhaust means 8, which is set in advance in accordance with a series of casting steps, is input thereto. This preset decompression pattern can be experimentally determined, and a specific example thereof will be described below.

Here, in the core 4 in the suction pressure casting device 1 illustrated in FIG. 1, the contained amount of moisture and the hardened state using a binder (firing state and the polymerization state) are different, and the amount of moisture and the hardened state will also be different depending on the production lot and the storage condition. Consequently, when the molten metal 2 comes into contact with the core 4 at the time of casting, there is the risk that the amount of gas that is generated from the core 4 will change, resulting in a misrun or a gas defect due to the difference from the preset decompression pattern.

Figure 2:
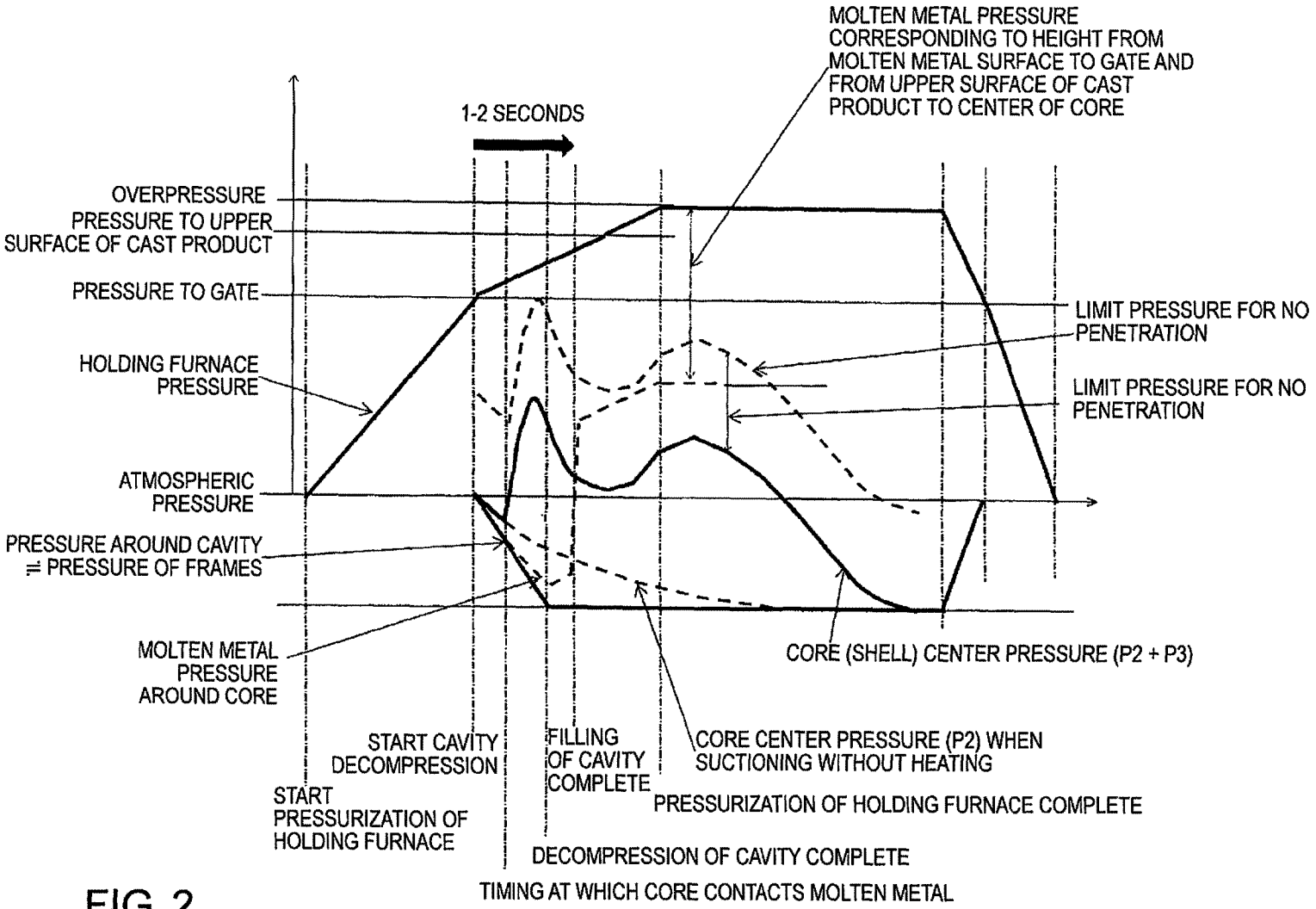
FIG. 2 is a graph illustrating pressure changes of the core and the holding furnace in a casting that uses a shell core.
Figure 3:
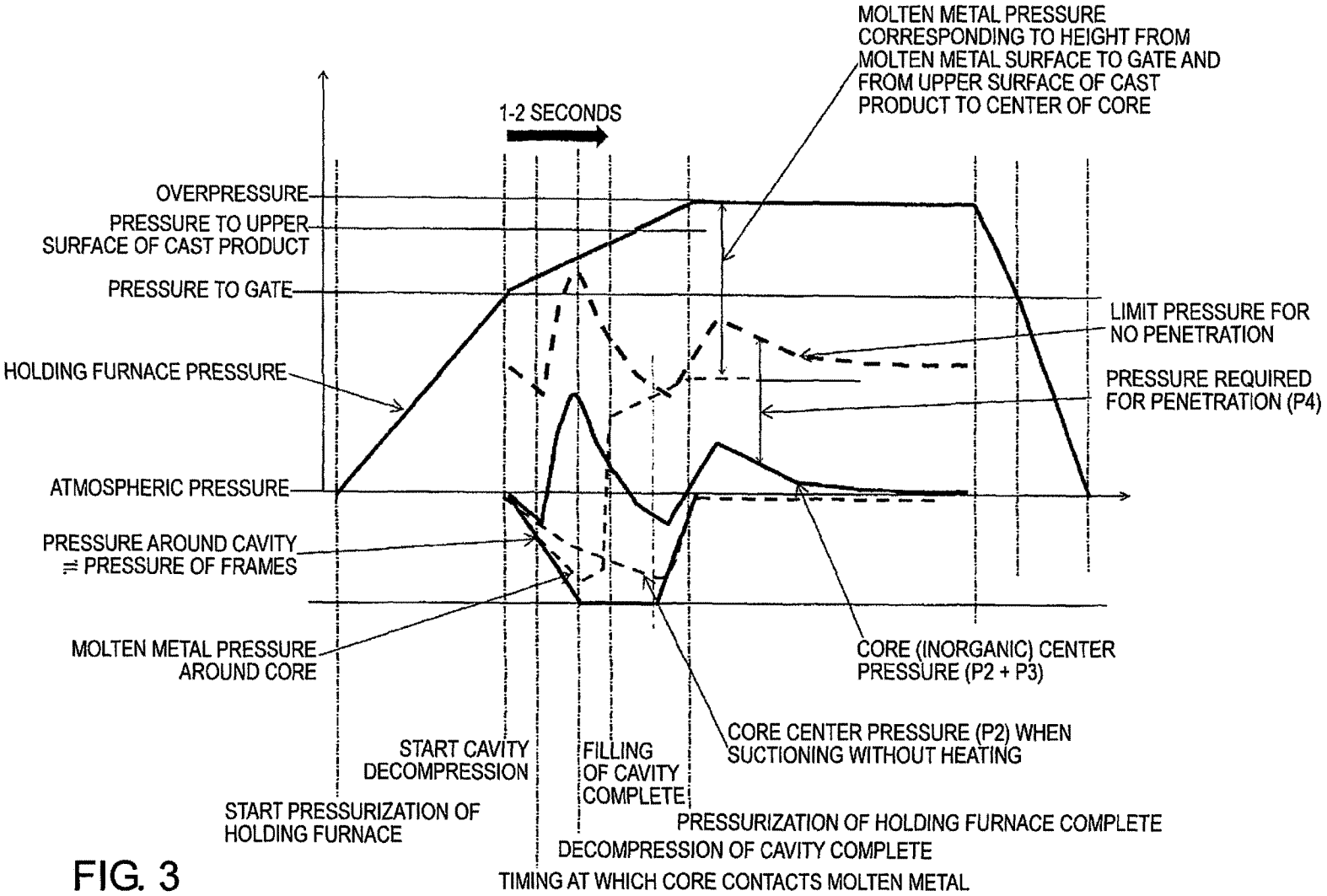
FIG. 3 is a graph illustrating pressure changes of the core and the holding furnace in a casting that uses an inorganic core.

FIG. 2 and FIG. 3 illustrates pressure changes of the core 4 that accompany pressure changes in the holding furnace 3. FIG. 2 illustrates the pressure changes when the core 4 is the above-described shell core, and FIG. 3 illustrates the pressure changes when the core 4 is the above-described inorganic core. The pressure of the holding furnace 3 is, directly, the supply pressure of the pressurizing gas, but indirectly indicates the pouring pressure of the molten metal 2 and the molten metal pressure inside the cavity 5.

In contrast, the main control device 13 has, as a function for executing the suction pressure casting method, a function to compare a preset decompression pattern with a measured pressure pattern of the cavity 5 and the core 4 that is measured during actual casting, to calculate a corrected decompression pattern of the suction-exhaust means 8 based on the difference therebetween, and to correct the preset decompression pattern at the time of the next casting by using the corrected decompression pattern.

Figure 4B:
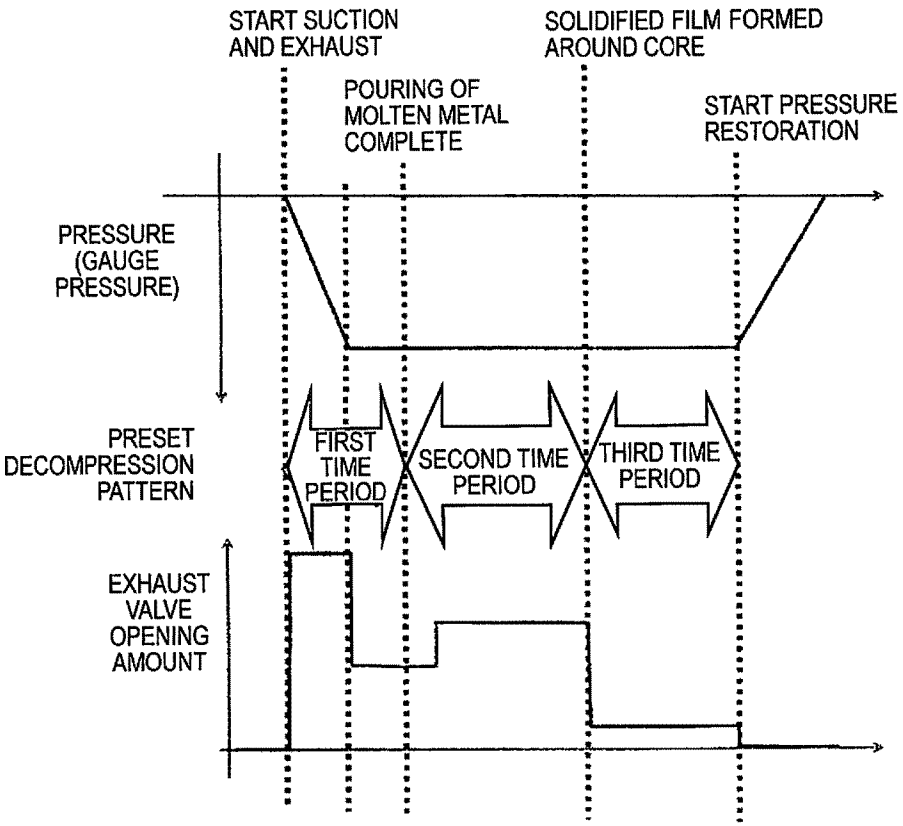
FIG. 4B is a graph illustrating the reduced pressure state of the cavity and the preset decompression pattern at the time of casting.
Figure 4A:
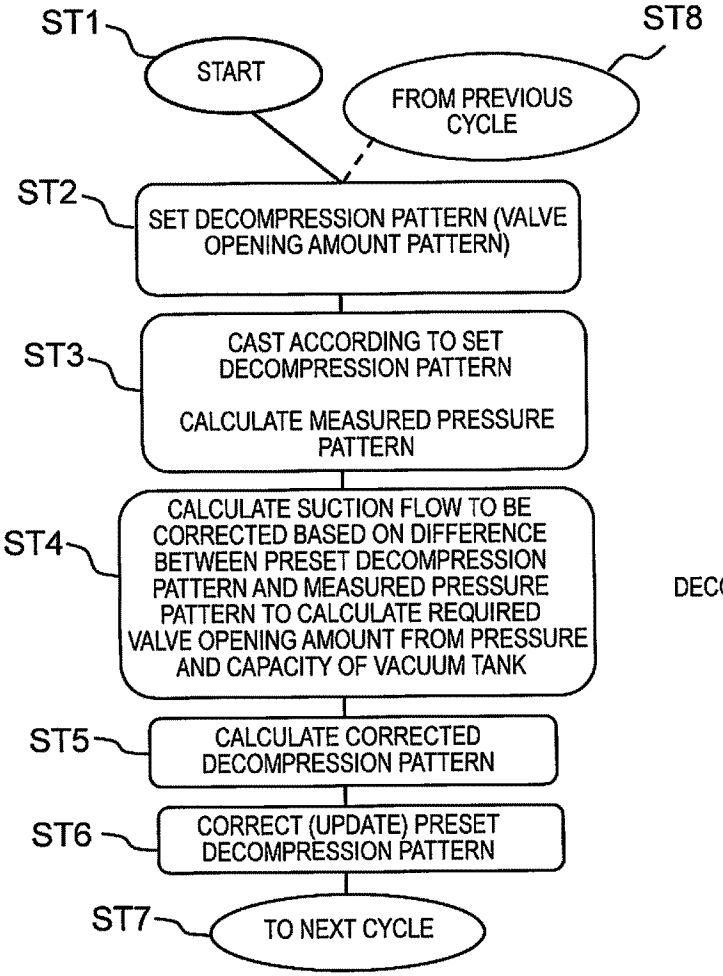
FIG. 4A is a flowchart for explaining the process of the suction pressure casting method.

That is, in the suction pressure casting method, after casting is started in Step ST1, a preset decompression pattern is set in Step ST2, and casting is carried out according to the preset decompression pattern in Step ST3, as illustrated in FIG. 4A.

Specifically, molten metal 2 is passed through the stoke 10 and the cavity 5 of the metal mold 6 is filled by pressurizing and supplying pressurizing gas (air) to the holding furnace 3 by the molten-metal pressurizing means 7, and each of the exhaust valves V2-V4 is operated and the interior of the cavity 5 and the interior of the decompression chassis 11 are suctioned and exhausted by the suction-exhaust means 8. At this time, the preset decompression pattern is a pattern for controlling the opening amount of the exhaust valves V2-V4, and FIG. 4B representatively illustrates the opening amount pattern of the first exhaust valve V2 for suctioning and exhausting the cavity 5.

Additionally, at the time of casting in Step ST3, a measured pressure pattern is calculated based on the measured values of the cavity pressure sensor S3, the core pressure sensor S4, and the decompression chassis pressure sensor S5. Then, in Step ST4, a suction and exhaust amount to be corrected from the difference between the preset decompression pattern and the measured pressure pattern is calculated, and the opening amount required for the exhaust valves V2-V4 is calculated from the capacity of the vacuum tank 8A and the internal pressure. The corrected decompression pattern is thereby calculated in Step ST5. At this time, the corrected decompression pattern is a pattern for controlling the opening amount of the exhaust valves V2-V4 in the same manner as the previous preset decompression pattern.

Then, in the suction pressure casting method, the initial preset decompression pattern is corrected (updated) to the corrected decompression pattern in Step ST6, and the process transitions to the subsequent casting cycle in Step ST7. As a result, the casting from the next time onward is started from the previous cycle in Step ST8, and the preset decompression pattern of Step ST2 becomes that which is updated in Step ST6, and the same process will be repeatedly carried out thereafter.

In this manner, in the suction pressure casting method described above, the preset decompression pattern and the measured pressure pattern are compared and a corrected decompression pattern is calculated based on the difference therebetween to correct the preset decompression pattern at the time of the next casting using the corrected decompression pattern; therefore, the difference between the preset decompression pattern (opening amount pattern of the exhaust valves) and the ideal decompression pattern that is necessary to carry out suction and exhaust including the actual amount of gas that is generated becomes small, and it is possible to inhibit the occurrence of a misrun or a gas defect, even when the hardened state using a binder and the amount of moisture of the core 4 are different.

If cast products are to be mass-produced continuously by the suction pressure casting method described above, cores 4 are also continuously produced in the same manner. Thus, it is unlikely that the amount of moisture of individual cores 4 and the hardened states thereof will be significantly different, and the differences in the amount of moisture and the hardened state will be relatively small for those cores that are continuously produced; the differences in the amount of moisture and the hardened state will be relatively large for those cores in which the production lot and the storage condition are different. Therefore, in the suction pressure casting method, since the state of each core 4 will not be significantly different, by reflecting the calculated corrected decompression pattern to the next casting, it is possible to reduce the error of the pattern and to suppress the occurrence of a misrun or a gas defect.

Additionally, as a more preferable embodiment, in the suction pressure casting method, the measured pressure pattern of the cavity 5 and the core 4 comprises a first time period from the start of pouring of the molten metal 2 to the completion of pouring, a second time period from the completion of pouring the molten metal 2 to when a solidified film of the molten metal 2 is formed in the periphery of the core 4, and a third time period from the formation of the solidified film of the molten metal 2 in the periphery of the core 4 to when the suction and exhaust of the cavity 5 is stopped, as illustrated in FIG. 4B. Then, in the suction pressure casting method, a corrected decompression pattern of the suction-exhaust means 8 is calculated based on the difference between the preset decompression pattern and the measured pressure pattern, and at which time period the measured pressure deviates from the preset decompression pattern is displayed by the monitor (display means) 14.

In the first to the third time periods described above, the first time period from the start of the pouring of the molten metal 2 to the completion of pouring is a time period that is primarily affected by the amount of moisture of the core 4. Additionally, the second time period from the completion of pouring of the molten metal 2 to when a solidified film of the molten metal 2 is formed in the periphery of the core 4 is a time period that is primarily affected by the hardened state using a binder (calcination degree and polymerization degree) of the core 4. Furthermore, the third time period from the formation of the solidified film of the molten metal 2 in the periphery of the core 4 to when the suction and exhaust of the cavity 5 is stopped is a time period that is affected by leaks due to deterioration of the seal of the metal mold 6.

Furthermore, as a more preferable embodiment, in the suction pressure casting method, a preset pressurizing pattern of the molten-metal pressurizing means 7 is used, which is set in advance according to a series of the casting process, in the second time period described above, and it is determined that an abnormality has occurred in the cast product when the measured pressure of the core 4 becomes higher than the molten metal pressure of the periphery of the core 4 determined from the preset pressurizing pattern of the molten-metal pressurizing means 7. This determination result of an abnormality can also be displayed on the monitor 14.

Furthermore, as a more preferable embodiment, in the suction pressure casting method, a preset pressurizing pattern of the molten-metal pressurizing means 7 is used, which is set in advance according to a series of the casting process, and a corrected decompression pattern is calculated such that, in the second time period described above, the difference between the measured pressure of the core 4 and the molten metal pressure of the periphery of the core 4 determined from the preset pressurizing pattern of the molten-metal pressurizing means 7 becomes a predetermined value or less.

Here, in FIGS. 2 and 3, the molten metal pressure of the periphery of the core 4 is essentially equal to the pressure inside the cavity 5 until the completion of pouring of the cavity 5 with molten metal 2 (first time period). In addition, after the aforementioned pouring of the molten metal 2

(second time period), the molten metal pressure of the periphery of the core 4 is the pressure obtained by subtracting the molten metal pressure corresponding to the height from the molten metal surface inside the holding furnace 3 to the center of the core 4, from the pressure inside the holding furnace 3.

Before filling with the molten metal 2, gas from the core 4 that is ejected in the cavity 5 is mainly the moisture contained in the core 4 that has evaporated, and is not likely to be taken into the cast product to generate a gas defect, but does change the amount of gas inside the cavity 5 and the decompression chassis 11 to be suctioned and exhausted. Consequently, unless the suction amount by the suction-exhaust means 8 is increased if the amount of moisture contained in the core 4 is large, and the suction amount is set small if the amount of moisture is small, the desired preset decompression pattern cannot be maintained, and the possibility that a filling defect will occur in the thin walled portions, etc., becomes high.

Additionally, when using a shell core as illustrated in FIG. 2, gas that is generated from the core 4 after pouring the molten metal 2 into the cavity 5 is mainly generated by the binder undergoing thermal degeneration and fluctuates due to the sintering degree and fluctuations in the amount of binder added of the core 4. Until a solidified film is formed in the periphery of the core 4 (second time period), if the gas pressure inside the core 4 becomes higher than the molten metal pressure of the periphery of the core 4, gas is ejected into the molten metal 2, and the gas is taken up into the cast product, causing a gas defect. The gas inside the core 4 is led to the suction-exhaust means 8 via the frames 4A, or the like.

Therefore, if the pressure of the suction-exhaust means 8 is monitored and the pressure is higher than the desired set pressure, it is likely that the amount of generated gas from the core 4 is large relative to the suction amount, and that gas is ejecting from the core 4 into the molten metal 2 to generate a gas defect.

Furthermore, if the pressure of the suction-exhaust means 8 is monitored and the pressure is lower than the desired set pressure, then the amount of generated gas from the core 4 will be less than the suction amount, and if the pressure becomes low relative to the molten metal pressure of the periphery of the core 4, penetration will occur, wherein molten metal 2 penetrates between the sands of the core 4, resulting in a burning defect.

Furthermore, the pressure of the decompression chassis 11 and the cavity 5 after the molten metal 2 in the periphery of the core 4 forms a solidified film (third time period) fluctuates depending on the amount of leakage from the seal of the decompression chassis 11. In this third time period, if the pressure of the suction-exhaust means 8 is monitored and the pressure does not decrease to the desired set pressure, it is likely that the leak is increasing.

In response to such a situation, as described above, in the suction pressure casting method, a corrected decompression pattern of the suction-exhaust means 8 is calculated, and at which of the first to the third time periods the measured pressure deviates from the preset decompression pattern is displayed on the monitor 14. As a result, in the suction pressure casting method, it is possible to promptly ascertain the amount of moisture and the hardened state using a binder (sintering degree and the polymerization degree) of the core 4, or such conditions as a gas leak due to seal deterioration, in order to promptly report such abnormalities to an operator, for example, and it is possible to realize a more accurate control of the suction-exhaust means 8 and to take preventive measures for facility maintenance, and the like.

In addition, as described above, in the suction pressure casting method, a preset pressurizing pattern of the molten-metal pressurizing means 7 is used, and it is determined that an abnormality has occurred in the cast product when, in the second time period, the measured pressure of the core 4 exceeds the molten metal pressure of the periphery of the core 4 determined from the preset pressurizing pattern of the molten-metal pressurizing means 7. That is, in the suction pressure casting method, if the measured pressure of the core 4 becomes higher than the molten metal pressure of the periphery of the core 4, it is extremely likely that a gas defect has occurred; therefore, it is possible to prevent an outflow of defective products by treating the abnormality.

Furthermore, as described above, in the suction pressure casting method, a preset pressurizing pattern of the molten-metal pressurizing means 7 is used, and a corrected decompression pattern is calculated, such that, in the second time period, the difference between the measured pressure of the core 4 and the molten metal pressure of the periphery of the core 4 determined from the preset pressurizing pattern becomes a predetermined value or less. Thus, in the suction pressure casting method, excessive pressure is prevented from being applied in advance, and molten metal 2 will not permeate (penetrate) between the core sands, so that it is possible to prevent an occurrence of a burning defect.

FIG. 5A to FIG. 7B are views for explaining devices for experiments carried out to set the preset decompression pattern (opening amount pattern of the exhaust valves) of the suction-exhaust means 8.

Figure 5B:
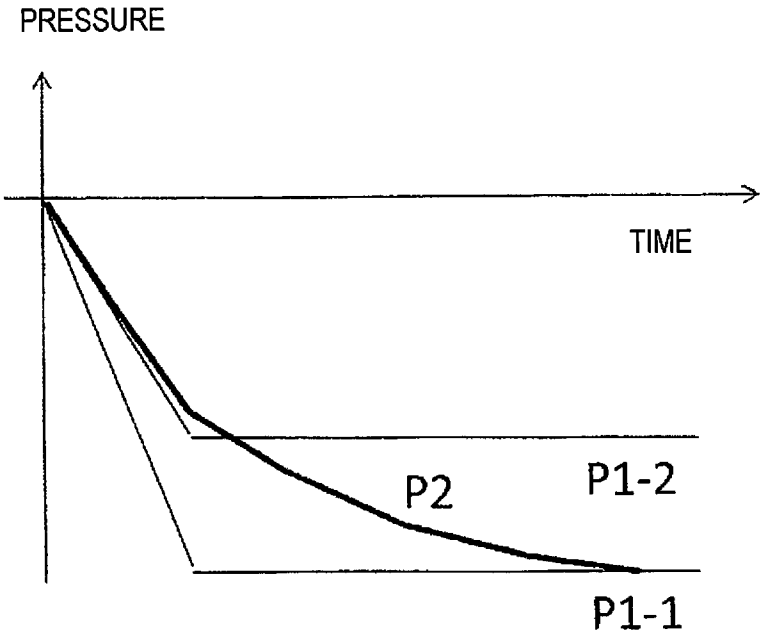
FIG. 5B is a graph illustrating changes in the internal pressure of the core.
Figure 5A:
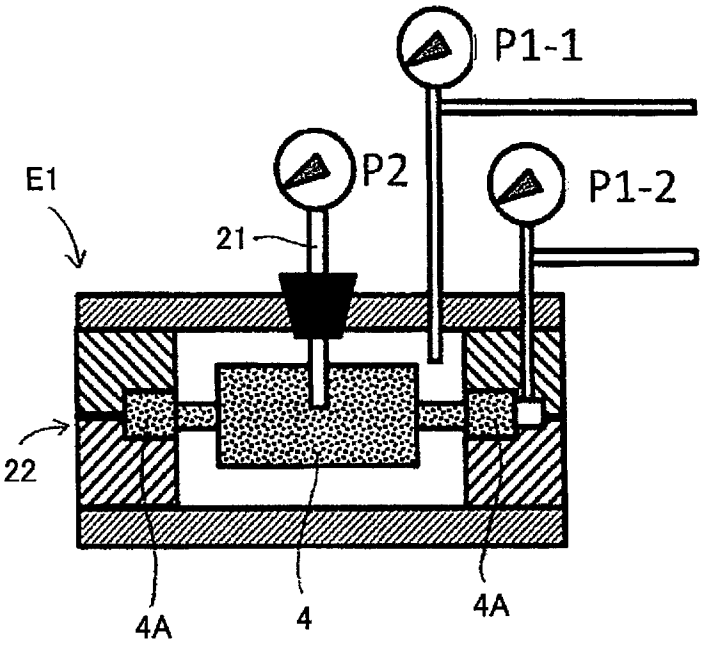
FIG. 5A is a cross-sectional view illustrating an experimental device for determining the internal pressure of the core as reference.

The experimental device E1 illustrated in FIG. 5A is a device for determining a reference internal pressure of the core, where a core 4 provided with a pressure-measuring pipe 21 in the center is housed in a vacuum chamber 22 by holding the frames 4A, and the inside of the vacuum chamber 22 is decompressed to determine the pressure P1-1 inside the vacuum chamber 22, the pressure P1-2 of the frames 4A of the core 4, and the pressure P2 of the center of the core 4.

As a result, regarding the pressure P1-1 of the vacuum chamber 22 and the pressure P1-2 of the frames 4A of the core 4, the pressure values of both suction and exhaust are reduced and held to a constant pressure, as illustrated in FIG. 5B. The center pressure P2 of the center of the core 4 is gradually reduced to reach the pressure of the cavity 5.

Figure 6B:
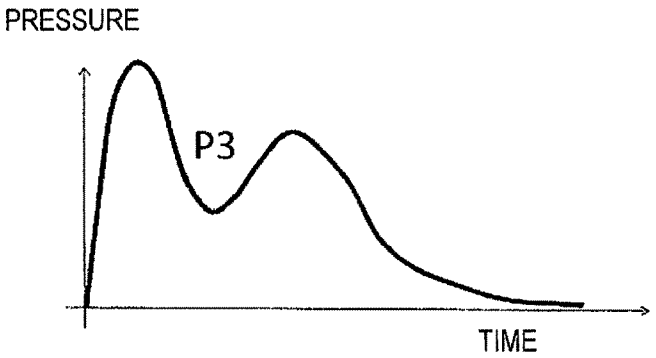
FIG. 6B is a graph illustrating changes in the internal pressure of a shell core.
Figure 6C:
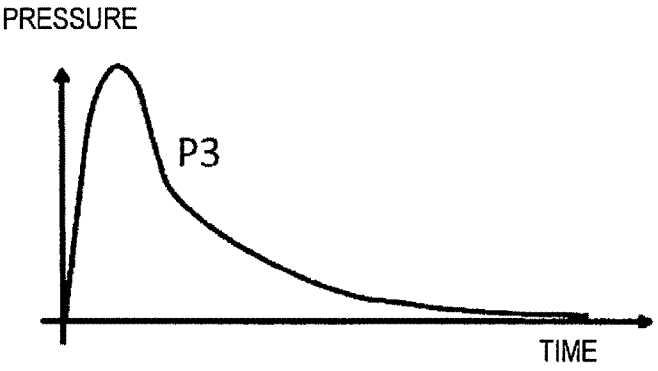
FIG. 6C is a graph illustrating changes in the internal pressure of an inorganic core.
Figure 6A:
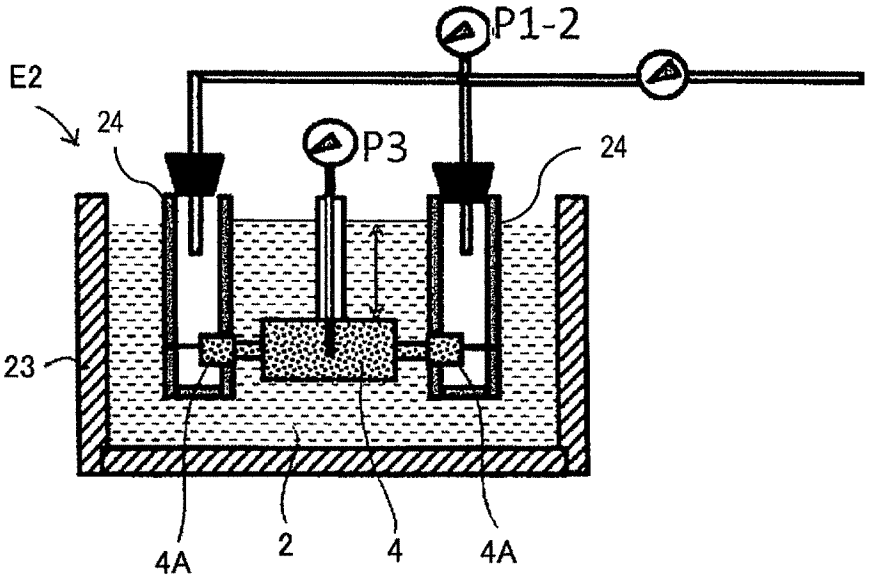
FIG. 6A is a cross-sectional view illustrating an experimental device for determining the internal pressure of the core when pressurized by molten metal.

The experimental device E2 illustrated in FIG. 6A is a device for determining the internal pressure of the core when pressurized by the molten metal 2, in which a core 4 provided with a pressure-measuring pipe in the center is immersed in the molten metal 2 in a vessel 23 such that a head pressure is applied by holding the frames 4A; at this time, the frame is held by a hollow body 24 and exposed to an atmospheric pressure equivalent, to measure the center pressure P3 of the core 4 and the pressure P1-2 of the frames 4A.

FIG. 6B illustrates pressure changes when the core 4 is a shell core (refer to FIG. 2), which has a peak due to gas that is generated by thermal denaturation of the binder after having a peak due to generation of water vapor, which decreases thereafter. FIG. 6C illustrates pressure changes when the core 4 is an inorganic core (refer to FIG. 3), which decreases after having a peak due to generation of water vapor.

Figure 7B:
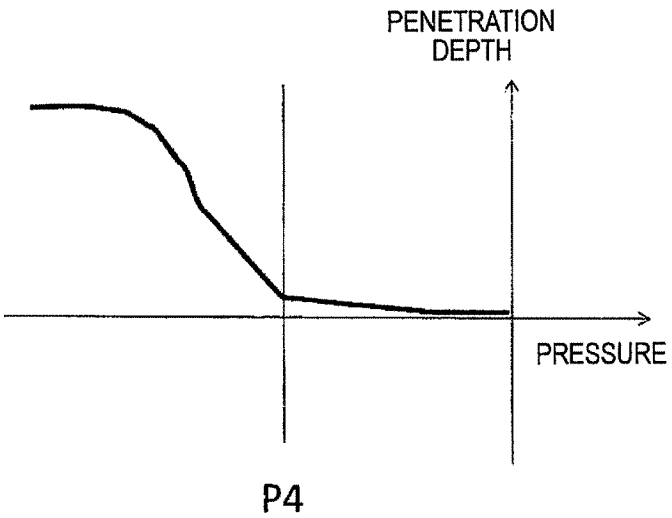
FIG. 7B is a graph illustrating pressure change.
Figure 7A:
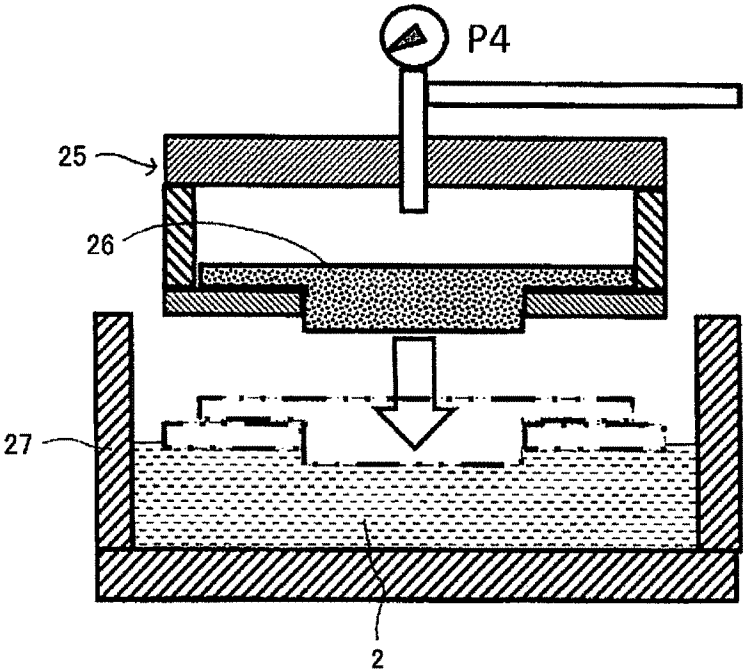
FIG. 7A is a cross-sectional view illustrating an experimental device for determining the pressure at which molten metal penetration occurs.

The experimental device E3 illustrated in FIG. 7A is a device for determining the pressure at which penetration of the molten metal 2 occurs, which is installed on the bottom surface of a vacuum box 25 such that a core material 26 is exposed, and the pressure inside the vacuum box 25 is changed; then, an experiment is carried out to cause the core material 26 to come into contact with the molten metal 2 inside the vessel 27, as illustrated by the imaginary line in the figure, and the pressure P4 at which penetration does not occur on the surface of the core material 26 is measured. As a result, the pressure is gradually reduced after being suddenly reduced, as illustrated in FIG. 7B.

The sum of the center pressure P2 and the molten metal pressure P3 is used as the center pressure of the core 4 used for the preset decompression pattern and the preset pressurizing pattern. In addition, a correction amount estimated from the pressure of the frames 4A can be added to the center pressure of the core 4.

The molten metal pressure of the periphery of the core 4 is set to the pressure of the cavity 5 during pouring of the molten metal 2, and is set to a pressure obtained by subtracting the pressure corresponding to the molten metal height, obtained by adding the height from the molten metal surface inside the holding furnace 3 to the gate and the height from the core center to the upper surface of the cast product, from the pressure of the holding furnace 3, at the time of the completion of the pouring of the molten metal 2.

A pressure obtained by subtracting the pressure P4 at which penetration does not occur from the sum of the center pressure P2 and the molten metal pressure P3 is used as the burn-in limit pressure. Alternatively, the burn-in limit pressure may be the difference between the pressure obtained by subtracting the pressure corresponding to the molten metal height, obtained by adding the height from the molten metal surface inside the holding furnace 3 to the gate and the height from the core center to the upper surface of the cast product, from the pressure of the holding furnace 3, and the pressure P4 at which penetration does not occur.

Then, from immediately before (for example, a few seconds before) the completion of pouring of molten metal to after (for example, a few seconds after) the completion of the pouring of the molten metal, during the time until a predetermined thickness from the surface of the core 4 of solidified film is formed, the pressure of the holding furnace 3 is controlled such that the molten metal pressure of the periphery of the core 4 exceeds the center pressure of the core 4 and is lower than the burn-in limit pressure.

In this way of thinking, a set pressure reduction pattern (opening degree pattern of the exhaust valves) of the suction-exhaust means 8 is created. The valve control is not a feedback control but a pattern control. In addition, during a casting cycle, the pressure of the cavity 5 and the pressure of the frames 4A are monitored to evaluate the deviation amount from the preset decompression pattern.

Then, the evaluation value described above is used to correct (update) the preset decompression pattern of the next casting cycle. Additionally, as a method of evaluating the deviation between the actual measured value and the preset decompression pattern, attention is paid to the interval immediately after core immersion, the denaturation time period of the binder, and the interval of core gas stabilization; upon pattern control. It is more preferable that a plurality of valves are provided in the same system, and to assign priorities to each so that the response-to-control speed can be improved.

The specific configuration of the suction pressure casting method according to the present invention is not limited to the above-described embodiments, and details of the configurations may be appropriately changed without departing from the scope of the present invention.

The invention claimed is:

1. A suction pressure casting method comprising using a casting device to carry out suction pressure casting in which molten metal is pressurized and poured into a cavity of a metal mold and the cavity is suctioned and exhausted, the casting device including a holding furnace in which molten metal is accumulated, the metal mold that forms the cavity together with a core, a molten-metal pressurizing device including a pressurized gas tank for supplying pressurizing gas into the holding furnace, and a suction-exhaust device for suctioning and exhausting an interior of the cavity, the suction-exhaust device including a vacuum pump, a first exhaust pipe in communication with the cavity, a second exhaust pipe in communication with the core, a first exhaust valve provided in the first exhaust pipe, and a second exhaust valve provided in the second exhaust pipe;

setting a preset decompression pattern of the suction-exhaust device in advance according to a casting process;

comparing the preset decompression pattern to a measured pressure pattern of the cavity and the core that is measured during actual casting, the measured pressure pattern comprising a first time period from a start of pouring of the molten metal to a completion of pouring, a second time period from the completion of pouring the molten metal to when a solidified film of the molten metal is formed in a periphery of the core, and a third time period from the formation of the solidified film of the molten metal in the periphery of the core to when the suctioning and exhausting of the cavity is stopped;

calculating a corrected decompression pattern of the suction-exhaust device based on a difference between the preset decompression pattern and the measured pressure pattern;

correcting the preset decompression pattern at a time of a subsequent casting cycle by using the corrected decompression pattern, the corrected decompression pattern of the suction-exhaust device being calculated based on the difference between the preset decompression pattern and the measured pressure pattern, and at which time period the measured pressure deviates from the preset decompression pattern being displayed by a display device;

using a preset pressurizing pattern of the molten-metal pressurizing device set in advance according to the casting process; and in the second time period, determining that an abnormality has occurred in a cast product when the measured pressure of the core exceeds the molten metal pressure of the periphery of the core determined from the preset pressurizing pattern of the molten-metal pressurizing device, the preset decompression pattern and the corrected decompression pattern being patterns for controlling opening amounts of the first and second exhaust valves.

2. The suction pressure casting method according to claim 1, wherein the suction-exhaust device further includes a vacuum tank connected to the first exhaust pipe and the second exhaust pipe, the first exhaust valve being disposed between the vacuum tank and the cavity and the second exhaust valve being disposed between the vacuum tank and the core.

3. The suction pressure casting method according to claim 1, wherein the casting device further includes a decompression chassis for hermetically enclosing the metal mold, and the suction-exhaust device further includes a third exhaust pipe in communication with an interior of the decompression chassis and a third exhaust valve provided in the third exhaust pipe, the preset decompression pattern and the corrected decompression pattern being patterns for controlling opening amounts of the first, second, and third exhaust valves.

4. A suction pressure casting method comprising using a casting device to carry out suction pressure casting in which molten metal is pressurized and poured into a cavity of a metal mold and the cavity is suctioned and exhausted, the casting device including a holding furnace in which molten metal is accumulated, the metal mold that forms the cavity together with a core, a molten-metal pressurizing device including a pressurized gas tank for supplying pressurizing gas into the holding furnace, and a suction-exhaust device for suctioning and exhausting an interior of the cavity, the suction-exhaust device including a vacuum pump, a first exhaust pipe in communication with the cavity, a second exhaust pipe in communication with the core, a first exhaust valve provided in the first exhaust pipe, and a second exhaust valve provided in the second exhaust pipe;

setting a preset decompression pattern of the suction-exhaust device in advance according to a casting process;

comparing the preset decompression pattern to a measured pressure pattern of the cavity and the core that is measured during actual casting, the measured pressure pattern comprising a first time period from a start of pouring of the molten metal to a completion of pouring, a second time period from the completion of pouring the molten metal to when a solidified film of the molten metal is formed in a periphery of the core, and a third time period from the formation of the solidified film of the molten metal in the periphery of the core to when the suctioning and exhausting of the cavity is stopped;

calculating a corrected decompression pattern of the suction-exhaust device based on a difference between the preset decompression pattern and the measured pressure pattern; and correcting the preset decompression pattern at a time of a subsequent casting cycle by using the corrected decompression pattern, the corrected decompression pattern of the suction-exhaust device being calculated based on the difference between the preset decompression pattern and the measured pressure pattern, and at which time period the measured pressure deviates from the preset decompression pattern being displayed by a display device;

using a preset pressurizing pattern of the molten-metal pressurizing device set in advance according to the casting process; and in the second time period, calculating the corrected decompression pattern such that the difference between the measured pressure of the core and the molten metal pressure of the periphery of the core determined from the preset pressurizing pattern of the molten-metal pressurizing device becomes a predetermined value or less, the preset decompression pattern and the corrected decompression pattern being patterns for controlling opening amounts of the first and second exhaust valves.

5. The suction pressure casting method according to claim 4, wherein the suction-exhaust device further includes a vacuum tank connected to the first exhaust pipe and the second exhaust pipe, the first exhaust valve being disposed between the vacuum tank and the cavity and the second exhaust valve being disposed between the vacuum tank and the core.

* * * * *